US006382376B1

(12) United States Patent
Rosen et al.

(10) Patent No.: US 6,382,376 B1
(45) Date of Patent: May 7, 2002

(54) MULTIPURPOSE LUGGAGE SET

(76) Inventors: Lawrence Rosen, 100 Main St., White Plains, NY (US) 10601; William Loscher, 9 Hazelton Dr., White Plains, NY (US) 10605

( * ) Notice: Subject to any disclaimer, the term of this patent is extended or adjusted under 35 U.S.C. 154(b) by 10 days.

(21) Appl. No.: 09/833,443

(22) Filed: Apr. 12, 2001

Related U.S. Application Data

(66) Substitute for application No. 09/133,447 on Aug. 13, 1998, now abandoned.

(51) Int. Cl.[7] ..... A45C 3/00

(52) U.S. Cl. ..... 190/108; 190/903; 150/105; 150/119

(58) Field of Search ..... 190/108, 903; 150/103, 104, 105, 119

(56) References Cited

U.S. PATENT DOCUMENTS

| | | | | | |
|---|---|---|---|---|---|
| 1,734,587 | A | * | 11/1929 | Lowe | 150/103 |
| 2,574,089 | A | * | 11/1951 | Cochran | 190/903 X |
| RE25,826 | E | * | 8/1965 | Ward | 190/108 X |
| 3,881,534 | A | | 5/1975 | Gist | |
| 3,944,032 | A | | 3/1976 | Samhammer et al. | |
| 4,153,146 | A | | 5/1979 | Patton et al. | |
| 4,273,223 | A | | 6/1981 | Tomlinson | |
| 4,436,189 | A | | 3/1984 | Baum | |
| 4,472,870 | A | | 9/1984 | Kotkins, Jr. | |
| 4,569,082 | A | | 2/1986 | Ainsworth et al. | |
| 4,573,202 | A | | 2/1986 | Lee | |
| 4,756,394 | A | * | 7/1988 | Cohen | 190/108 X |
| D313,316 | S | | 1/1991 | Nordstrom | |
| 5,054,589 | A | | 10/1991 | Bomes et al. | |
| 5,207,254 | A | | 5/1993 | Fromm | |
| 5,209,279 | A | * | 5/1993 | Wilson | 190/108 X |
| 5,413,199 | A | | 5/1995 | Clement | |
| 5,839,577 | A | | 11/1998 | Friedler | |
| 5,875,876 | A | * | 3/1999 | Wang | 190/108 X |
| 5,894,975 | A | | 4/1999 | Holden et al. | |
| 6,003,573 | A | * | 12/1999 | Owens | 150/104 |
| 6,213,267 | B1 | * | 4/2001 | Miller | 190/108 |

FOREIGN PATENT DOCUMENTS

| | | |
|---|---|---|
| DE | WO 93/07777 | 4/1993 |
| GB | 2 260 894 | 5/1993 |

* cited by examiner

*Primary Examiner*—Lee Young
*Assistant Examiner*—Tri M. Mai

(57) ABSTRACT

A multipurpose luggage set for providing travelers with expanded storage space when returning home with added items. The luggage set includes an exterior bag having an opening into a hollow interior of the bag, and an interior bag dimensioned for being removably nested in the hollow interior of the exterior bag. The interior bag has an opening into a hollow interior. When the interior bag is nested in the exterior bag, the invention permits removably connection of the bags in a manner such that the interior of the interior bag is accessible through the opening in the exterior bag.

4 Claims, 2 Drawing Sheets

MULTIPURPOSE LUGGAGE SET

REFERENCE TO RELATED APPLICATION

This application is a substitute for application Ser. No. 09/133,447, filed Aug. 13, 1998, abandoned.

BACKGROUND OF THE INVENTION

1. Field of the Invention

The present invention relates to luggage and more particularly pertains to a new multipurpose luggage set for providing travelers with expanded storage space when returning home with added items.

2. Description of the Prior Art

The use of luggage is known in the prior art. More specifically, luggage heretofore devised and utilized are known to consist basically of familiar, expected and obvious structural configurations, notwithstanding the myriad of designs encompassed by the crowded prior art which have been developed for the fulfillment of countless objectives and requirements.

Known prior art luggage include U.S. Pat. Nos. 4,153,146 to Patton et al.; 5,054,589 to Bomes et al.; 4,472,870 to Kotkins, Jr.; 4,436,189 to Baum; 3,944,032 to Samhammer et al.; and U.S. Pat. No. Des. 313,316 to Nordstrom.

While these devices fulfill their respective, particular objectives and requirements, the aforementioned patents do not disclose a new multipurpose luggage set. The inventive device includes an exterior bag having a top wall with an opening therethrough exposing a hollow interior thereof. The opening has a lower mating half of a zipper extending partially around a periphery of the opening, and an upper mating half of a zipper extending partially around its periphery disposed above the lower mating half. The exterior bag has a lid portion dimensioned for positioning in the opening in the top wall, and has a rear edge secured to a rear edge of the opening. The lid portion has a mating half of a zipper extending partially around a periphery thereof, with the mating half of the zipper of the lid portion selectively engaging the upper mating half of the zipper of the opening. An interior bag is dimensioned for being received within the hollow interior of the exterior bag, and has a top wall with an opening therethrough exposing a hollow interior thereof. The opening has a lower mating half of a zipper extending partially around a periphery of the opening, and has an upper mating half of a zipper extending partially around its periphery disposed above the lower mating half. The interior bag has a lid portion that is dimensioned for positioning in the opening in the top wall and has a rear edge secured to a rear edge of the opening. The lid portion has a mating half of a zipper extending partially around a periphery of the lid portion, and the mating half of the zipper of the lid portion selectively engages the lower mating half of the zipper of the opening. The interior bag is nestable in the interior of the exterior bag, and the upper mating half of the zipper of the interior bag being selectively securable to the lower mating half of the zipper of the exterior bag when the bags are in a nested condition such that the periphery of the opening of the exterior bag is selectively unitable to the periphery of the opening of the interior bag to form a single integral opening. The opening of the interior bag is substantially coextensive with the opening of the exterior bag such that the top wall of the interior bag does not constrict access into the interior of the interior bag when the bags are in a nested condition.

In these respects, the multipurpose luggage set according to the present invention substantially departs from the conventional concepts and designs of the prior art, and in so doing provides an apparatus primarily developed for the purpose of providing travelers with expanded storage space when returning home with added items.

SUMMARY OF THE INVENTION

In view of the foregoing disadvantages inherent in the known types of luggage now present in the prior art, the present invention provides a new multipurpose luggage set construction wherein the same can be utilized for providing travelers with expanded storage space when returning home with added items.

The general purpose of the present invention, which will be described subsequently in greater detail, is to provide a new multipurpose luggage-set apparatus and method which has many of the advantages of the luggage mentioned heretofore and many novel features that result in a new multipurpose luggage set which is not anticipated, rendered obvious, suggested, or even implied by any of the prior art luggage, either alone or in any combination thereof.

To attain this, the present invention generally comprises an exterior bag having a top wall with an opening therethrough exposing a hollow interior thereof. The opening has a lower mating half of a zipper extending partially around a periphery of the opening, and an upper mating half of a zipper extending partially around its periphery disposed above the lower mating half. The exterior bag has a lid portion dimensioned for positioning in the opening in the top wall, and has a rear edge secured to a rear edge of the opening. The lid portion has a mating half of a zipper extending partially around a periphery thereof, with the mating half of the zipper of the lid portion selectively engaging the upper mating half of the zipper of the opening. An interior bag is dimensioned for being received within the hollow interior of the exterior bag, and has a top wall with an opening therethrough exposing a hollow interior thereof. The opening has a lower mating half of a zipper extending partially around a periphery of the opening, and has an upper mating half of a zipper extending partially around its periphery disposed above the lower mating half. The interior bag has a lid portion that is dimensioned for positioning in the opening in the top wall and has a rear edge secured to a rear edge of the opening. The lid portion has a mating half of a zipper extending partially around a periphery of the lid portion, and the mating half of the zipper of the lid portion selectively engages the lower mating half of the zipper of the opening. The interior bag is nestable in the interior of the exterior bag, and the upper mating half of the zipper of the interior bag being selectively securable to the lower mating half of the zipper of the exterior bag when the bags are in a nested condition such that the periphery of the opening of the exterior bag is selectively unitable to the periphery of the opening of the interior bag to form a single integral opening. The opening of the interior bag is substantially coextensive with the opening of the exterior bag such that the top wall of the interior bag does not constrict access into the interior of the interior bag when the bags are in a nested condition.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multipurpose luggage set apparatus and method which has many of the advantages of the luggage mentioned heretofore and many novel features that result in a new multipurpose luggage set which is not anticipated, rendered obvious, suggested, or even implied by any of the prior art luggage, either alone or in any combination thereof.

It is another object of the present invention to provide a new multipurpose luggage set which may be easily and efficiently manufactured and marketed.

It is a further object of the present invention to provide a new multipurpose luggage set which is of a durable and reliable construction.

An even further object of the present invention is to provide a new multipurpose luggage set which is susceptible of a low cost of manufacture with regard to both materials and labor, and which accordingly is then susceptible of low prices of sale to the consuming public, thereby making such multipurpose luggage set economically available to the buying public.

Still yet another object of the present invention is to provide a new multipurpose luggage set which provides in the apparatuses and methods of the prior art some of the advantages thereof, while simultaneously overcoming some of the disadvantages normally associated therewith.

Still another object of the present invention is to provide a new multipurpose luggage set for providing travelers with expanded storage space when returning home with added items.

Yet another object of the present invention is to provide a new multipurpose luggage set which includes an exterior bag having a top wall with an opening therethrough exposing a hollow interior thereof. The opening has a lower mating half of a zipper extending partially around a periphery of the opening, and an upper mating half of a zipper extending partially around its periphery disposed above the lower mating half. The exterior bag has a lid portion dimensioned for positioning in the opening in the top wall, and has a rear edge secured to a rear edge of the opening. The lid portion has a mating half of a zipper extending partially around a periphery thereof, with the mating half of the zipper of the lid portion selectively engaging the upper mating half of the zipper of the opening. An interior bag is dimensioned for being received within the hollow interior of the exterior bag, and has a top wall with an opening therethrough exposing a hollow interior thereof. The opening has a lower mating half of a zipper extending partially around a periphery of the opening, and has an upper mating half of a zipper extending partially around its periphery disposed above the lower mating half. The interior bag has a lid portion that is dimensioned for positioning in the opening in the top wall and has a rear edge secured to a rear edge of the opening. The lid portion has a mating half of a zipper extending partially around a periphery of the lid portion, and the mating half of the zipper of the lid portion selectively engages the lower mating half of the zipper of the opening. The interior bag is nestable in the interior of the exterior bag, and the upper mating half of the zipper of the interior bag being selectively securable to the lower mating half of the zipper of the exterior bag when the bags are in a nested condition such that the periphery of the opening of the exterior bag is selectively unitable to the periphery of the opening of the interior bag to form a single integral opening. The opening of the interior bag is substantially coextensive with the opening of the exterior bag such that the top wall of the interior bag does not constrict access into the interior of the interior bag when the bags are in a nested condition.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
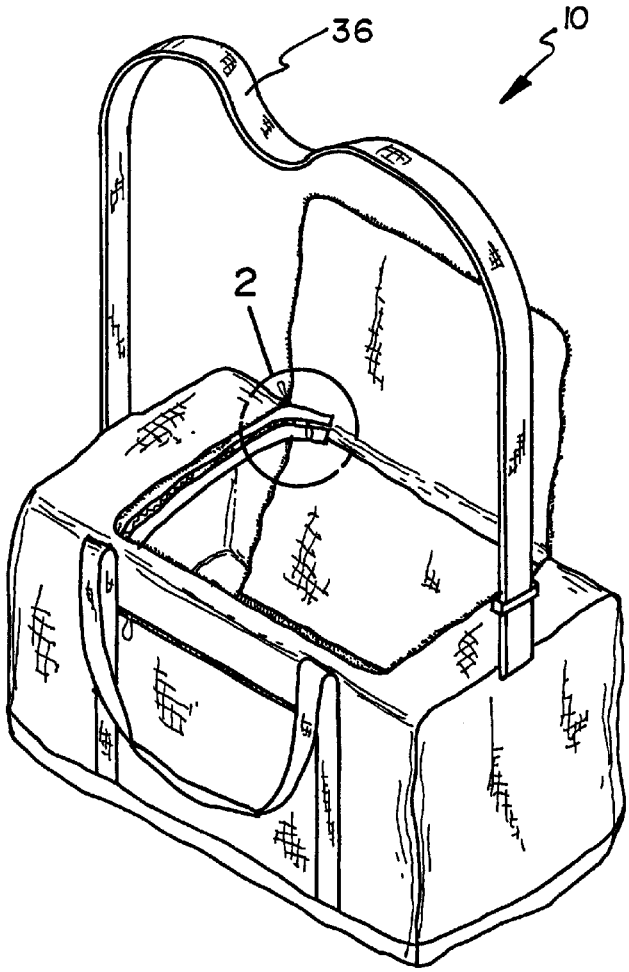
FIG. 1 is a perspective view of a new multipurpose luggage set according to the present invention.
Figure 2:
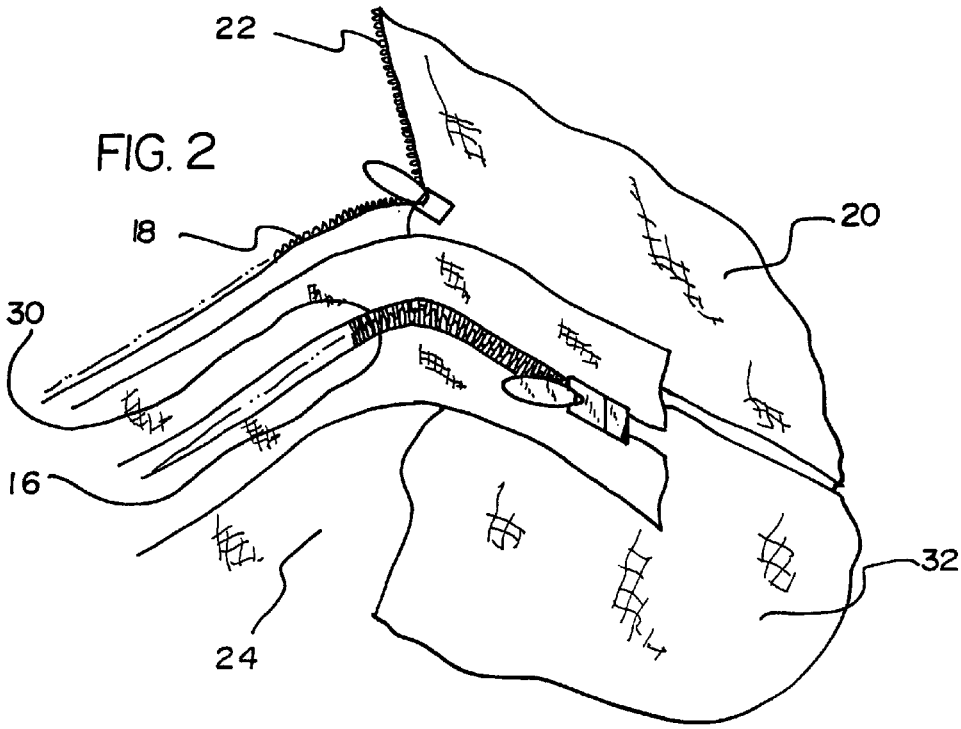
FIG. 2 is a sectional view of the present invention as taken from circle 2 of FIG. 1.
Figure 3:
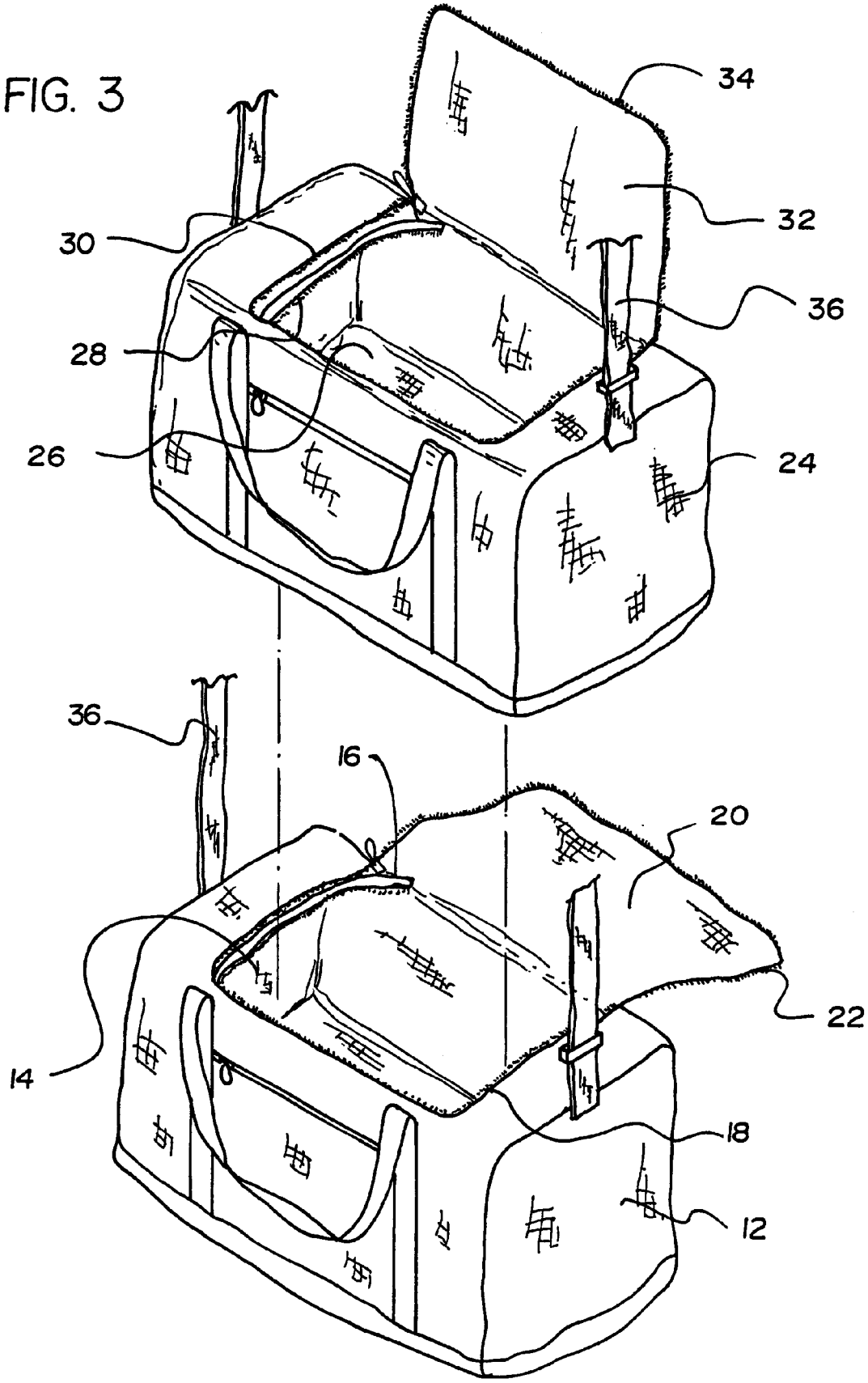
FIG. 3 is an exploded perspective view of the present invention.

With reference now to the drawings, and in particular to FIGS. 1 through 3 thereof, a new multipurpose luggage set embodying the principles and concepts of the present invention and generally designated by the reference numeral 10 will be described.

As best illustrated in FIGS. 1 through 3, the multipurpose luggage set 10 comprises an exterior bag 12 defined by a top wall, a bottom wall, opposed front and rear walls, and opposed side walls. The top wall has an opening 14 therethrough exposing a hollow interior of the exterior bag. The opening 14 has a lower mating half of a zipper 16 extending partially around a periphery thereof. The opening 14 has an upper mating half of a zipper 18 extending partially around its periphery disposed above the lower mating half 16. The exterior bag 12 has a lid portion 20 dimensioned for positioning within the opening 14 in the top wall. The lid portion 20 has a rear edge secured to a rear edge of the opening 14. The lid portion 20 has a mating half of a zipper 22 extending partially around a periphery thereof. The mating half of the zipper 22 of the lid portion 20 selectively engages the upper mating half 18 of the zipper of the opening 14.

An interior bag 24 is provided and is defined by a top wall, a bottom wall, opposed front and rear walls, and opposed side walls. The interior bag 24 is dimensioned for being received within the hollow interior of the exterior bag 12. The top wall has an opening 26 therethrough exposing a hollow interior of the interior bag 24. The opening 26 has a lower mating half of a zipper 28 extending partially around a periphery thereof. The opening 26 has an upper mating half of a zipper 30 extending partially around its periphery disposed above the lower mating half 28. The interior bag 24 has a lid portion 32 dimensioned for positioning within the opening 26 in the top wall. The lid portion 32 has a rear edge secured to a rear edge of the opening 26. The lid portion 32 has a mating half of a zipper 34 extending partially around a periphery thereof. The mating half of the zipper 34 of the lid portion 32 selectively engages the lower mating half of the zipper 28 of the opening 26. The upper mating half of the zipper 30 of the interior bag 24 selectively mates with the lower mating half of the zipper 16 of the exterior bag 12 whereby the interior bag 24 is secured within the exterior bag 32.

The exterior bag 12 and the interior bag 24 would each be provided with a carrying strap 36 to facilitate the transportation thereof. Additional pouches could also be incorporated into the walls of the bags.

In use, the interior bag 24 is inserted and secured within the hollow interior of the exterior bag 12 through the coupling of the mating halves of the respective zippers. The user would then fill the interior of the interior bag 24 when packing and the two bags would be carried as one. When returning from a trip, the interior bag 24 would be disconnected from the exterior bag 12 and both bags could be employed separately.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A multipurpose luggage set for providing travelers with expanded storage space when returning home with added items, the luggage set comprising:

an exterior bag having a hollow interior defined by a top wall, a bottom wall, opposed front and rear walls, and opposed side walls, the top wall having an opening into the hollow interior of the exterior bag, the opening having a lower mating half of a zipper extending partially around a periphery of the opening, the opening having an upper mating half of a zipper extending partially around its periphery disposed above the lower mating half, the exterior bag having a lid portion dimensioned for positioning in the opening in the top wall, the lid portion having a rear edge secured to a rear edge of the opening, the lid portion having a mating half of a zipper extending partially around a periphery thereof, the mating half of the zipper of the lid portion selectively engaging the upper mating half of the zipper of the opening; and an interior bag having a hollow interior defined by a top wall, a bottom wall, opposed front and rear walls, and opposed side walls, the interior bag being dimensioned for being received within the hollow interior of the exterior bag, the top wall having an opening into the hollow interior of the interior bag, the opening having a lower mating half of a zipper extending partially around a periphery thereof, the opening having an upper mating half of a zipper extending partially around its periphery disposed above the lower mating half, the interior bag having a lid portion dimensioned for positioning in the opening in the top wall, the lid portion having a rear edge secured to a rear edge of the opening, the lid portion having a mating half of a zipper extending partially around a periphery thereof, the mating half of the zipper of the lid portion selectively engaging the lower mating half of the zipper of the opening;

wherein the interior bag is nestable in the interior of the exterior bag, the upper mating half of the zipper of the interior bag being selectively securable to the lower mating half of the zipper of the exterior bag when the bags are in a nested condition such that the periphery of the opening of the exterior bag is selectively unitable to the periphery of the opening of the interior bag to form a single integral opening; and wherein the opening of the interior bag is substantially coextensive with the opening of the exterior bag such that the top wall of the interior bag does not constrict access into the interior of the interior bag when the bags are in a nested condition, each of the exterior and interior bags being formed of similar material such that the bags may carried as separate bags with a matching appearance.

2. The multipurpose luggage set as set forth in claim 1 wherein the exterior bag and the interior bag each have a shoulder strap secured thereto for permitting each bag to be carried separately of the other bag.

3. A multipurpose luggage set for providing travelers with expanded storage space when returning home with added items, the luggage set comprising:

an exterior bag having a top wall with an opening therethrough exposing a hollow interior thereof, the opening having a lower mating half of a zipper extending partially around a periphery of the opening, the opening having an upper mating half of a zipper extending partially around its periphery disposed above the lower mating half, the exterior bag having a lid portion dimensioned for positioning in the opening in the top wall, the lid portion having a rear edge secured to a rear edge of the opening, the lid portion having a mating half of a zipper extending partially around a periphery thereof, the mating half of the zipper of the lid portion selectively engaging the upper mating half of the zipper of the opening; and an interior bag dimensioned for being received within the hollow interior of the exterior bag, the interior bag having a top wall with an opening therethrough exposing a hollow interior thereof, the opening having a lower mating half of a zipper extending partially around a periphery of the opening, the opening having an upper mating half of a zipper extending partially around its periphery disposed above the lower mating half, the interior bag having a lid portion dimensioned for positioning in the opening in the top wall, the lid portion having a rear edge secured to a rear edge of the opening, the lid portion having a mating half of a zipper extending partially around a periphery thereof, the mating half of the zipper of the lid portion selectively engaging the lower mating half of the zipper of the opening;

wherein the interior bag is nestable in the interior of the exterior bag, the upper mating half of the zipper of the interior bag being selectively securable to the lower mating half of the zipper of the exterior bag when the bags are in a nested condition such that the periphery of the opening of the exterior bag is selectively unitable to the periphery of the opening of the interior bag to form a single integral opening; and wherein the opening of the interior bag is substantially coextensive with the opening of the exterior bag such that the top wall of the interior bag does not constrict access into the interior of the interior bag when the bags are in a nested condition.

4. The multipurpose luggage set as set forth in claim 3 wherein the exterior bag and the interior bag each have a shoulder strap secured thereto for permitting each bag to be carried separately of the other bag.

* * * * *